US010485392B2

(12) United States Patent
Wang et al.

(10) Patent No.: US 10,485,392 B2
(45) Date of Patent: Nov. 26, 2019

(54) INTELLIGENT DUST MOP

(71) Applicants: NINGBO SHIJIA CLEANING TOOLS CO., LTD., Ningbo, Zhejiang Province (CN); NINGBO LERA ELECTRIC APPLIANCE CO., LTD., Ningbo, Zhejiang Province (CN)

(72) Inventors: Yongdong Wang, Ningbo (CN); Bin Li, Ningbo (CN)

(73) Assignees: NINGBO SHIJIA CLEANING TOOLS CO., LTD., Ningbo (CN); NINGBO LERA ELECTRIC APPLIANCE CO., LTD., Ningbo (CN)

( * ) Notice: Subject to any disclaimer, the term of this patent is extended or adjusted under 35 U.S.C. 154(b) by 0 days.

(21) Appl. No.: 15/836,945

(22) Filed: Dec. 11, 2017

(65) Prior Publication Data

US 2019/0090702 A1 Mar. 28, 2019

Related U.S. Application Data

(63) Continuation of application No. PCT/CN2017/107060, filed on Oct. 20, 2017.

(30) Foreign Application Priority Data

Sep. 27, 2017 (CN) ..... 2017 1 0885544

(51) Int. Cl.
*A47L 7/00* (2006.01)
*A47L 9/28* (2006.01)
(Continued)

(52) U.S. Cl.
CPC ..... *A47L 7/0014* (2013.01); *A47L 5/225* (2013.01); *A47L 9/02* (2013.01); *A47L 9/122* (2013.01);
(Continued)

(58) Field of Classification Search
CPC ..... A47L 7/0014; A47L 9/2847; A47L 13/20; A47L 13/256; A47L 5/225; A47L 9/02;
(Continued)

(56) References Cited

U.S. PATENT DOCUMENTS

2004/0134016 A1* 7/2004 Kisela ..... A47L 5/24 15/320
2004/0139572 A1* 7/2004 Kisela ..... A47L 5/24 15/320
(Continued)

*Primary Examiner* — Marc Carlson
(74) *Attorney, Agent, or Firm* — Adenike Adebiyi

(57) ABSTRACT

An intelligent dust mop has an air inlet and at least one air outlet. A dust collection component and a mop component in a detachable connection with the dust collection component are disposed at the position of the air inlet. The dust collection component and the mop component are arranged at the front and the back in parallel, and the dust collection component floats up and down along the thickness direction of the mop component. The intelligent dust mop integrates dust collection and mopping functions, performing dust collection and mopping synchronously, thus realizing one-step cleaning. In addition, the dust collection component is positioned at the front end of the mop component, solving the problem where dust or hair on the ground moves along with the mopping, thus improving labor productivity.

15 Claims, 13 Drawing Sheets

(51) Int. Cl.

| | |
|---|---|
| ***A47L 13/20*** | (2006.01) |
| ***A47L 5/22*** | (2006.01) |
| ***A47L 9/02*** | (2006.01) |
| ***A47L 9/12*** | (2006.01) |
| ***A47L 9/32*** | (2006.01) |
| ***A47L 13/256*** | (2006.01) |

(52) U.S. Cl.
CPC ..... *A47L 9/2847* (2013.01); *A47L 9/2857* (2013.01); *A47L 9/2884* (2013.01); *A47L 9/325* (2013.01); *A47L 13/20* (2013.01); *A47L 13/256* (2013.01)

(58) Field of Classification Search
CPC ..... A47L 9/122; A47L 9/2857; A47L 9/2884; A47L 9/325
See application file for complete search history.

(56) References Cited

U.S. PATENT DOCUMENTS

| | | | | |
|---|---|---|---|---|
| 2011/0005025 | A1* | 1/2011 | Carrington | A47L 7/0009 15/322 |
| 2012/0042462 | A1* | 2/2012 | Milanese | A47L 13/20 15/104.93 |
| 2016/0100734 | A1* | 4/2016 | Bassett | A47L 7/0004 15/322 |

* cited by examiner

INTELLIGENT DUST MOP

CROSS-REFERENCE TO RELATED APPLICATIONS

This application is a continuation of International Application No. PCT/CN2017/107060 with a filing date of 20 Oct. 2017, which claims priority to Chinese Application No. 201710885544.4 with a filing date of 27 Sep. 2017, the disclosures of which are incorporated herein by reference.

TECHNICAL FIELD

The present invention belongs to the technical field of machinery, and relates to a mop, in particular to an intelligent dust mop.

BACKGROUND

At present, to clean a room or ground floor, it requires to collect dust in the room or on the ground floor, and then to mop the ground floor, resulting in repeated labor, low efficiency and slow cleaning. Therefore, dust collection and mopping are combined to generate new products. However, integrated products fail to go across step obstacles, causing poor dust collection effect and operation difficulties.

SUMMARY

One aspect of the present disclosure is an intelligent dust mop that integrates dust collection and mopping functions and that can easily go across step obstacles and operate smoothly.

In one example embodiment, the intelligent dust mop includes an air inlet and at least one air outlet. A dust collection component and a mop component in a detachable connection with the dust collection component are disposed at the position of the air inlet, wherein the dust collection component floats up and down along the thickness direction of the mop component.

In one example embodiment of the intelligent dust mop, two air outlets are provided and are symmetrically arranged, wherein the two air outlets and one air inlet form a triangular structure.

In one example embodiment of the intelligent dust mop, a plurality of air discharge fences are disposed at the position of each one of the air outlets, and each one of the air discharge fences is inclined downward.

In one example embodiment of the intelligent dust mop, the air discharge fences are distributed at an equal interval.

In one example embodiment of the intelligent dust mop, the middle portion of each one of the air discharge fences is protruded such that the air discharge fences entirely form an arch-structured.

In one example embodiment of the intelligent dust mop, each one of the air outlets includes a round disc, and a plurality of air discharge fences are uniformly distributed on the round disc, wherein a plurality of barbs are arranged along the axis direction of each one of the round discs, and the barbs are integrally molded the round discs.

In one example embodiment of the intelligent dust mop, at least one elastic component is disposed between the dust collection component and the mop component, and the two ends of the elastic component are respectively connected with the dust collection component and the mop component, wherein the dust collection component floats up and down along the thickness direction of the mop component through the elastic component.

In one example embodiment of the intelligent dust mop, the dust collection component has a first positioning portion for embedding one end of each one of the elastic components, and the mop component has a second positioning portion for clamping the other end of each corresponding one of the elastic components, wherein the first positioning portion and the second positioning portion are in a rotary plugged connection.

In one example embodiment of the intelligent dust mop, the mop component includes a base plate, and the base plate is provided with sticky barbs for absorbing and sticking a piece of mopping cloth.

In one example embodiment of the intelligent dust mop, a sleeve component is disposed between the mop component and the housing, wherein the sleeve component consists of two sleeve heads in mutually movable connection, one of the sleeve heads has one end connected to the housing, the other sleeve head has one end connected to the mop component, and the other end of each one of the two sleeve heads are connected through pins.

In one example embodiment of the intelligent dust mop, a hose is disposed as an air flow passage between the housing and the dust collection component, wherein one end of the hose is detachably connected to the housing, while the other end of the hose is detachably connected to the dust collection component, wherein the hose serves as a channel by which the macromolecular contaminant particles enter the housing via the air inlet.

In one example embodiment of the intelligent dust mop, a housing of the intelligent dust mop is in a detachable connection with a dust collecting box, and the dust collecting box and the housing are disassembled and assembled through a snap fastener, wherein the dust collecting box is positioned between the air outlet and the mop component.

In one example embodiment of the intelligent dust mop, a baffle is disposed on each one of the two sides of the first snap fastener, and the baffles and the housing are integrally molded or separately arranged, wherein the end faces of the baffles are higher than the end face of the first snap fastener.

In one example embodiment of the intelligent dust mop, a filter component is disposed above the opening of the dust collecting box, and the filter component is detachably connected to the inside of the housing.

In one example embodiment of the intelligent dust mop, a micro electric control component is in a detachable connection with the filter component, and a PCB is electrically connected with the micro electric control component, wherein the PCB is detachably connected to the inside of the housing.

In one example embodiment of the intelligent dust mop, the micro electric control component comprises a motor which is provided with an output shaft, a guide disc which is connected with the output shaft in a bushing way, and an end cover which is connected with the filter component in a buckling way, wherein the guide disc is positioned between the end cap and the filter component.

In one example embodiment of the intelligent dust mop, the guide disc comprises two parallel round slabs, and a plurality of first air deflectors are disposed in front of the two slabs, wherein first air deflector are integrally molded with the slabs or are assembled with the slabs in a split way.

In one example embodiment of the intelligent dust mop, the bending direction of the first air deflectors is consistent with the tangential direction of the round slabs.

In one example embodiment of the intelligent dust mop, the end cap is shaped as a round disc, and a plurality of second air deflectors are disposed along he axis direction of the end cap in a radiating way, wherein a gap is disposed between every two of adjacent second air deflectors.

In one example embodiment of the intelligent dust mop, the bending direction of the second air deflectors is consistent with the tangential direction of the end cap which is configured as a round disc.

In one example embodiment of the intelligent dust mop, an annular projection extends outwards along the thickness direction of the end cap, and a round hole is formed in the middle portion of the annular projection, wherein the middle portion of the annular projection serves as the installation space of the motor, and the around hole serves as a run-through channel of the output shaft.

In one example embodiment of the intelligent dust mop, a plurality of clamping blocks are disposed along the axial direction of the end cap, and the clamping blocks are positioned at the edge of the end cap and are matched with a clamping groove on the filter component.

In one example embodiment of the intelligent dust mop, the housing is internally equipped with a conductive component; one end of the conductive component is electrically connected with the PCB, and the other end of the conductive component is electrically connected with a handle, wherein the handle is provided with an ON/OFF button for starting the intelligent dust mop.

In one example embodiment of the intelligent dust mop, the conductive component includes an electric contactor; one end of the electric contactor is connected with the PCB through a lead, and the other end of the electric contactor is in a clamped connection with the other end of the handle 1300, wherein the handle is fixed on the housing through a thread fastener.

In one example embodiment of the intelligent dust mop, the PCB, the electric contactor and the handle keep a relatively constant distance two by two.

In one example embodiment of the intelligent dust mop, the electric contactor and the handle are in male-female match.

In one example embodiment of the intelligent dust mop, the housing is also internally provided with a lithium battery component which is electrically connected with the PCB, wherein the housing is also provided with a charging block, and the charging block is electrically connected with the PCB.

In one example embodiment of the intelligent dust mop, a power display screen is embedded on the surface of the housing to detect the power of the lithium battery component in real time.

In one example embodiment of the intelligent dust mop, an auxiliary grip is disposed at the joint between the housing and the handle, wherein the auxiliary grip is integrally molded with the housing.

In one example embodiment of the intelligent dust mop, the housing is provided with a second snap fastener, and the second snap fastener is positioned close to the map component, as a buckling button for replacing the functional tool bit.

In one example embodiment of the intelligent dust mop, a dust nozzle is clamped with the end of the housing, close to the position of the second snap fastener.

In one example embodiment of the intelligent dust mop, hair holes for implanting a hair brush are formed along the mouth edge of the dust nozzle.

The present disclosure may have the following beneficial effects:

The intelligent dust mop integrates dust collection and mopping functions, performing dust collection and mopping synchronously, thus realizing one-step cleaning. In addition, the dust collection component is positioned at the front end of the mop component, solving the problem of the dust or hair on the ground moving along with the mopping, thus improving labor productivity.

With the elastic component, the intelligent dust mop can easily go across steps when the dust collection component is collecting dust, realizing smoothness of dust collection and mopping and ensuring the dust collection reliability of the dust collection component. In addition, due to the elastic component, the dust collection component and the ground always keep a relatively stable distance, helping the dust collection component collect dust smoothly, reducing the friction between the dust collection component and the ground, and reducing noises.

The mopping cloth is a piece of U-shaped waved superfine fiber fabric with high abrasion resistance. In use, the mopping cloth is not sticky to the ground, thus saving force when mopping, and facilitating dust collection and cleaning. Besides, the mopping cloth can be repeatedly used for multiple times, improving the environmental-friendliness of the intelligent dust mop.

The strong suction force generated at the air inlet and the rotating speed of the motor are not reduced due to the loss of electricity in the intelligent dust mop, so the intelligent dust mop is long-lasting and keeps constant output during the cleaning work.

DETAILED DESCRIPTION

The technical solution of the present invention is further described in conjunction with preferred embodiments and attached drawings of the present invention, but the present invention is not limited to those embodiments.

Embodiment 1

Figure 1:
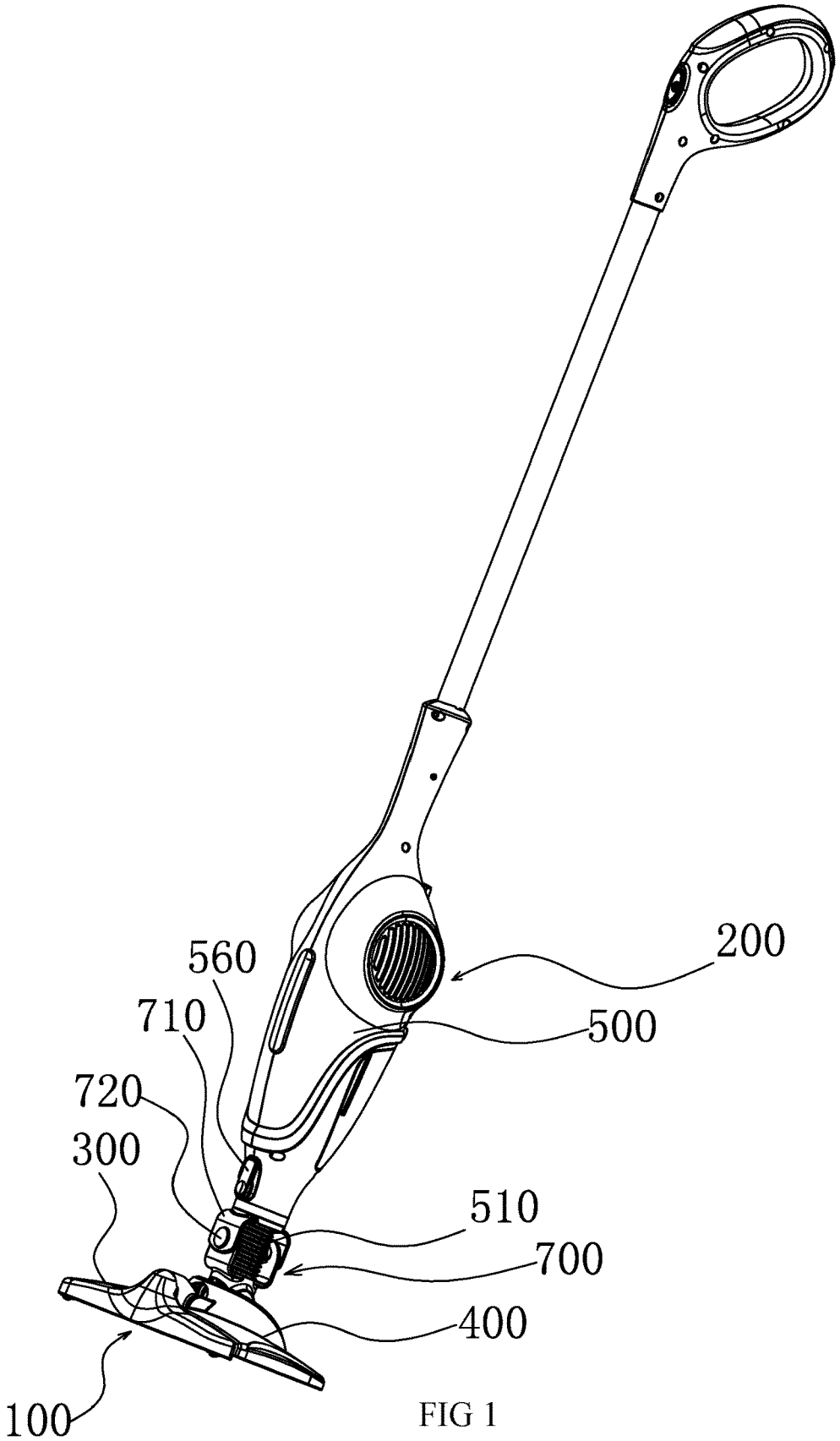
FIG. 1 is a structural view of an intelligent dust mop of the present invention.
Figure 2:
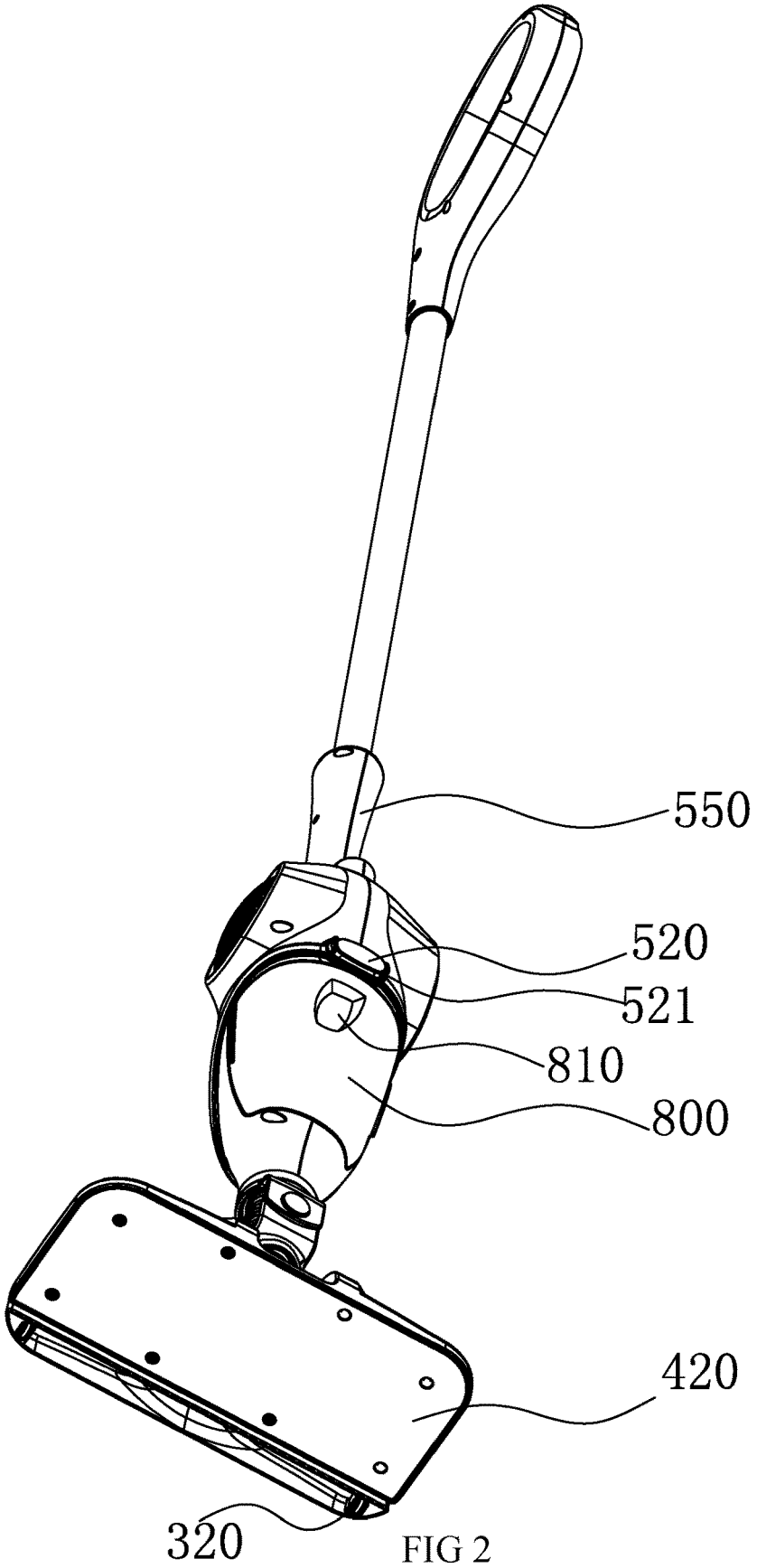
FIG. 2 is a structure view of the intelligent dust mop of the present invention at another angle.
Figure 3:
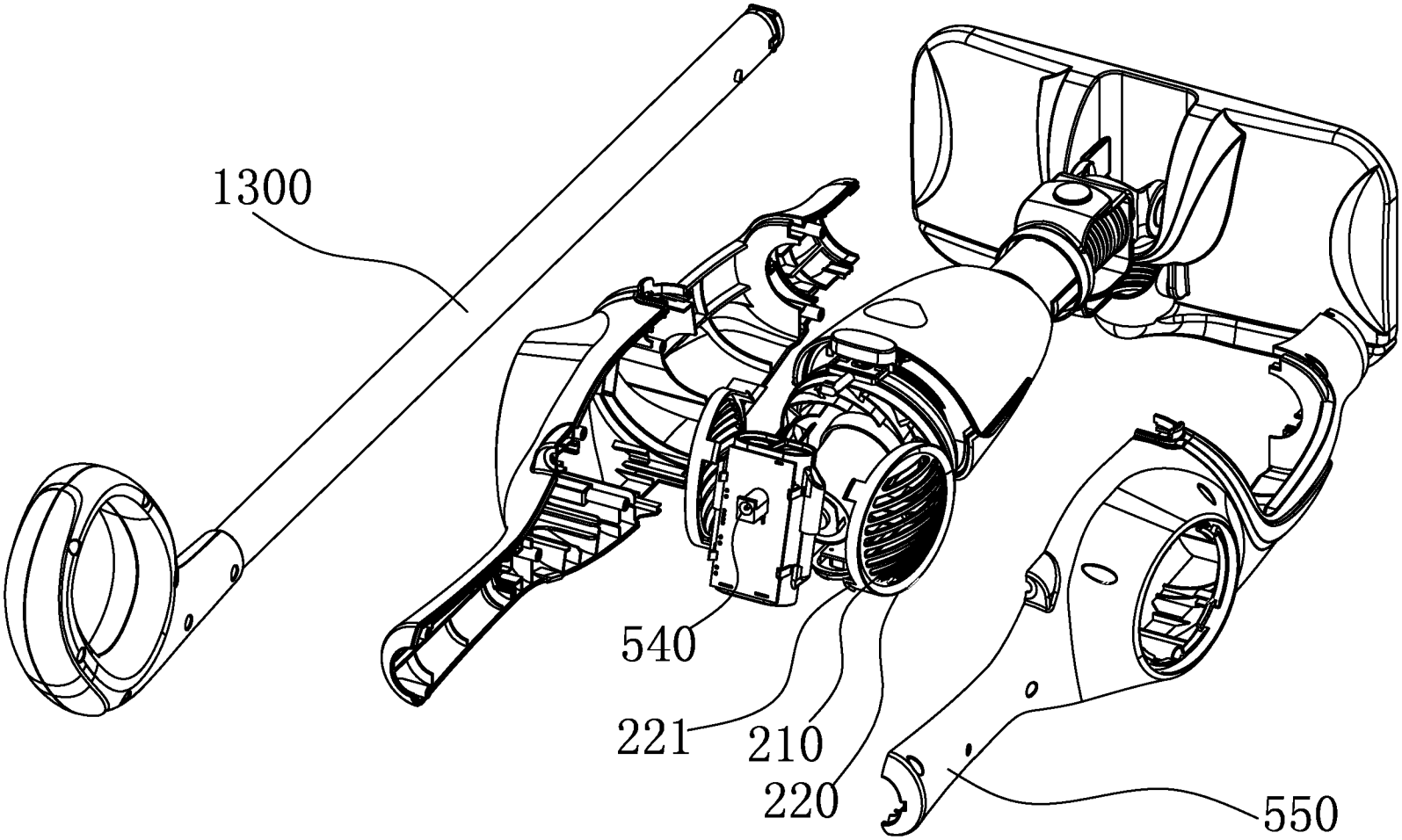
FIG. 3 is an exploded view of an intelligent dust mop of the present invention.
Figure 4:
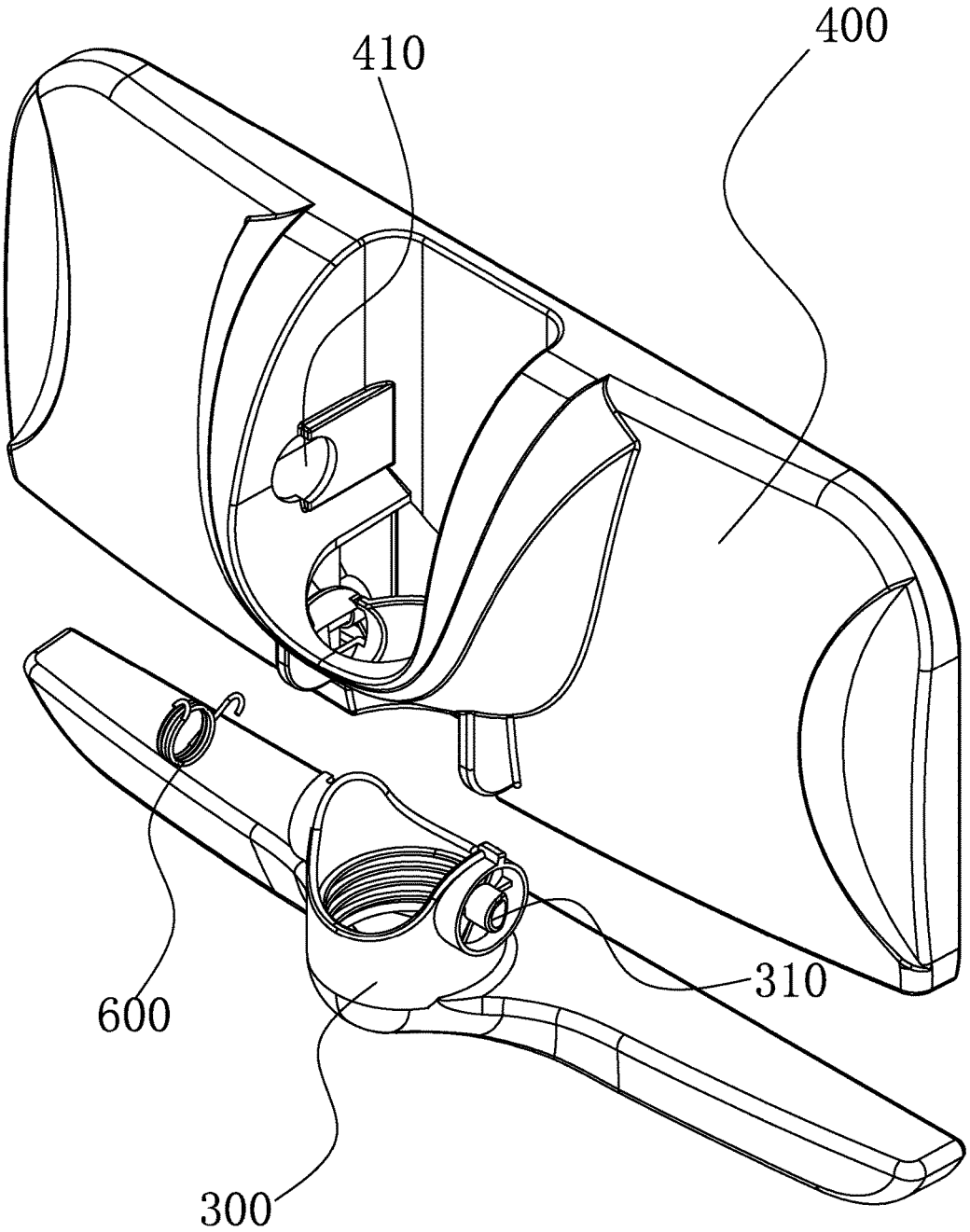
FIG. 4 is an exploded view of the first section of the intelligent dust mop in a preferable embodiment of the present invention.

As shown in FIGS. 1-3, the present invention provides a smart dust mop, including an air inlet 100 and at least one air outlet 200, and a dust collection assembly 300 and a mop assembly 400 which is detachably connected with the dust collection assembly 300 are disposed at the position of the air inlet 100, wherein the dust collection assembly 300 is positioned at the front end of the mop assembly 400, and the dust collection assembly 300 and the mop assembly 400 are disposed front and back in parallel.

The intelligent dust mop provided by the present invention integrates dust collection and mopping, and implements dust collection and mopping at the same time, further realizing cleaning. Besides, the dust collection assembly 300 is positioned at the front end of the mop assembly 400, solving the problem that dust or hair on the ground move along with mopping, thus enhancing the labor productivity.

Preferably, as shown in FIGS. 1-3, two air outlets 200 are provided and are symmetrically disposed, wherein the two air outlets 200 and one air inlet 100 form a triangular structure. By increasing the number of the air outlets 200, the air admission of the air inlet 100 increases, thus enhancing the mopping efficiency of the intelligent dust mop.

Further preferably, as shown in FIGS. 1-3, a plurality of air outflow fences 210 at disposed at the position of each one of the air outlets 200, and each one of the air outflow fences 210 are inclined downward. Further preferably, adjacent air outflow fences 210 are arranged at an equal interval, and by changing the air outflow direction, a downward inclined air guide portion is formed. By changing the direction and speed of the outflowing air, the noise frequency generated during the air discharge is reduced, thus improving the environmentally-friendly performance of the intelligent dust mop. Besides, the air outflow fences 210 are distributed at an equal interval, realizing equivalent treatment on the air volume during air discharge, and further reducing the frequency of the noises.

Further preferably, as shown in FIGS. 1-3, each one of the air outflow fences 210 has a protruding middle portion to form an arch-structure. On the one hand, the air discharge capacity of the intelligent dust mop is enhanced; on the other hand, the arched-shaped structure reduces the air speed during air discharge, plays a buffer solution, and therefore reduces the frequency of the noises during air discharge.

Further preferably, as shown in FIGS. 1-3, each on of the air outlets 200 includes a round disc 220, and a plurality of air outflow fences 210 are uniformly distributed on each one of the round discs 220, wherein a plurality of barbs 221 are disposed along the axial direction of each one of the ground discs 220, and the barbs 221 are integrally molded with each corresponding one of the round discs 220, realizing the clamping connection with a housing 500 in the intelligent dust mop, and preventing each corresponding one of the round discs 220 from being impacted by the outgoing air flow when the intelligent dust mop is working. In this way, the round discs 220 and the housing 500 rotate with respect to each other to change the outflow direction of the air, affecting the frequency of the noises that are generated during air discharge, thus further ensuring the reliability of the air discharge.

Preferably, as shown in FIGS. 1-4, at least one elastic component 600 is disposed between the dust collection component 300 and the mop component 400, and the two ends of the elastic component 600 are respectively connected with the dust collection component 300 and the mop component 400, wherein the dust collection component 300 floats up and down along the thickness direction (vertical direction) of the mop component 400 through the elastic component 600. In this way, the dust collection component 300 can easily go across steps when working, realizing smoothness in dust collection and mopping and ensuring the dust collection reliability of the dust collection component 300. In addition, due to the elastic component 600, the dust collection component 300 and the ground always keep a relatively stable distance, so the dust collection component 300 collects dust smoothly while the friction between the dust collection component 300 and the noises generated are reduced.

Further preferably, as shown in FIGS. 1-4, two elastic components 600 are provided, respectively positioned on two sides of the dust collection component 300 or on two sides of the mop component 400, so the two sides of the dust collection component 300 rise or drop synchronously, improving the dust collection reliability of the dust collection component 300. Further preferably, the elastic components 600 are symmetrically disposed on two sides of the dust collection component 300.

Further preferably, as shown in FIGS. 1-4, the dust collection component 300 has a first positioning portion 310 for embedding one end of each one of the elastic components 600, and the mop component 400 has a second positioning portion 410 for clamping the other end of each corresponding one of the elastic components 600, wherein the first positioning portion 310 and the second positioning portion 410 are in a rotary plugged connection. In this embodiment, various connection modes are adopted to realize the flexible installation of the elastic components 600; the bushing connection is adopted for realizing the positioning accuracy of the elastic components 600, while the buckling connection is adopted for facilitating the installation of the elastic components 600, thus ensuring that the dust collection component 300 is more reliable when floating up and down. Besides, when the dust collection component 300 floats up and down to go across the step, the rotary plugged connection structure formed by the first positioning portion 310 and the second positioning portion 410 drives the dust collection component 300 to rotate around the mop component 400, namely generating a little angular deflection, so the mop component 400 can easily mop the ground below the dust collection component 300.

Further preferably, as shown in FIGS. 1-4, the dust collection component 300 is provided with a travelling wheel 320 at each one of the two ends, so the contact between the dust collection component 300 and the ground is rolling contact, thus reducing friction between the dust collection component 300 and the ground, and realizing smooth dust collection.

Further preferably, as shown in FIGS. 1-4, the mop component 400 comprises a base plate 420, and the base plate 420 is provided with sticky barbs for absorbing and sticking a piece of mopping cloth, wherein in this embodiment, the mopping cloth is a piece of U-shaped waved super-fine fiber fabric with high abrasion resistance. In use, the mopping cloth is not sticky to the ground, thus saving force when mopping, and facilitating dust collection and cleaning. Besides, the mopping cloth can be repeatedly used for multiple times, improving the environmental-friendliness of the intelligent dust mop.

Further preferably, as shown in FIG. 1 and FIG. 2, a sleeve component 700 is disposed between the mop component 400 and the housing 500, wherein the sleeve component 700 consists of two sleeve heads 710 in mutually movable connection, one of the sleeve heads 700 has one end connected to the housing 500, the other sleeve head 710 has one end connected to the mop component 400, and the other end of each one of the two sleeve heads 710 are connected through pins 720. The included angle between the plane where the mop component 400 is positioned and the axial line of the housing 500 can be randomly changed, which means that the housing 500 can swing left and right around the pins 720, thus improving the working flexibility of the intelligent dust mop.

Further preferably, as shown in FIGS. 1-4, an air flow channel is formed between the air inlet 100 and each one of the air outlets 200, and the air flow channels communicate with the dust collection component 300, the mop component 400 and the housing 500 of the intelligent dust mop such that the macromolecular contaminant particles that enter the dust collection component 300 flow through the mop component 400, enter the housing 500 and the are kept in the housing 500, and the air removed with the macromolecular particles is discharged from the air outlets 200, thus completing the dust collection operation.

Further preferably, as shown in FIG. 1 and FIG. 2, a hose 510 is disposed as an air flow passage between the housing 500 and the dust collection component 300, and the hose 510 is preferably a corrugated pipe; one end of the hose 510 is detachably connected to the housing 500, while the other end of the hose 510 is detachably connected to the dust collection component 300, wherein the hose 510 serves as a channel by which the macromolecular contaminant particles enter the housing 500 via the air inlet 100, and when the housing 500 swings back and forth to result in angle change, the hose 510 performs telescoping movement to prevent the joints at the two ends of the hose 510 from disconnecting, thus improving the dust collection reliability of the intelligent dust collection component 300.

Figure 5:
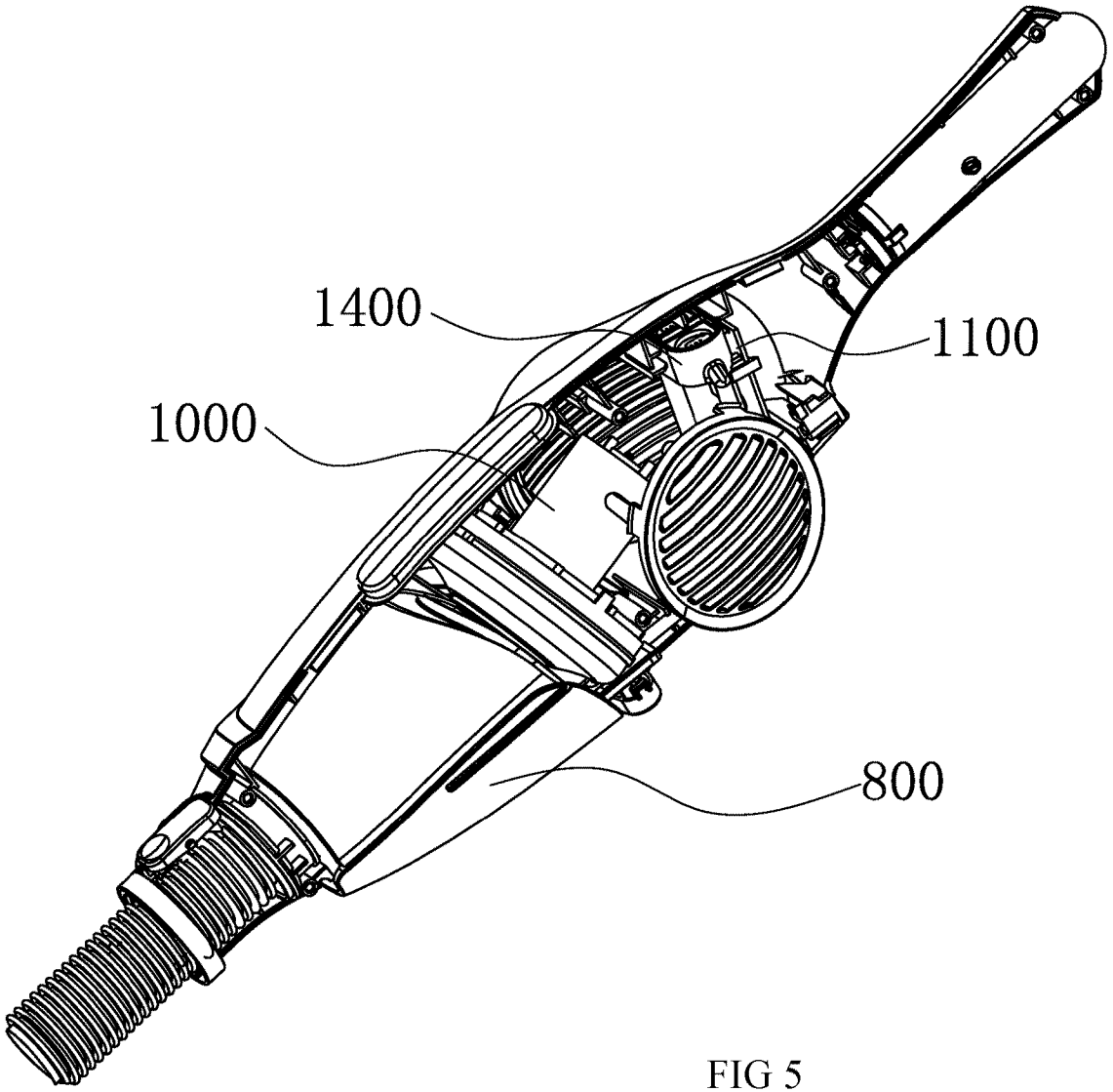
FIG. 5 is a schematic view A of the interior structure of the middle section of the intelligent dust mop in a preferable embodiment of the present invention.
Figure 6:
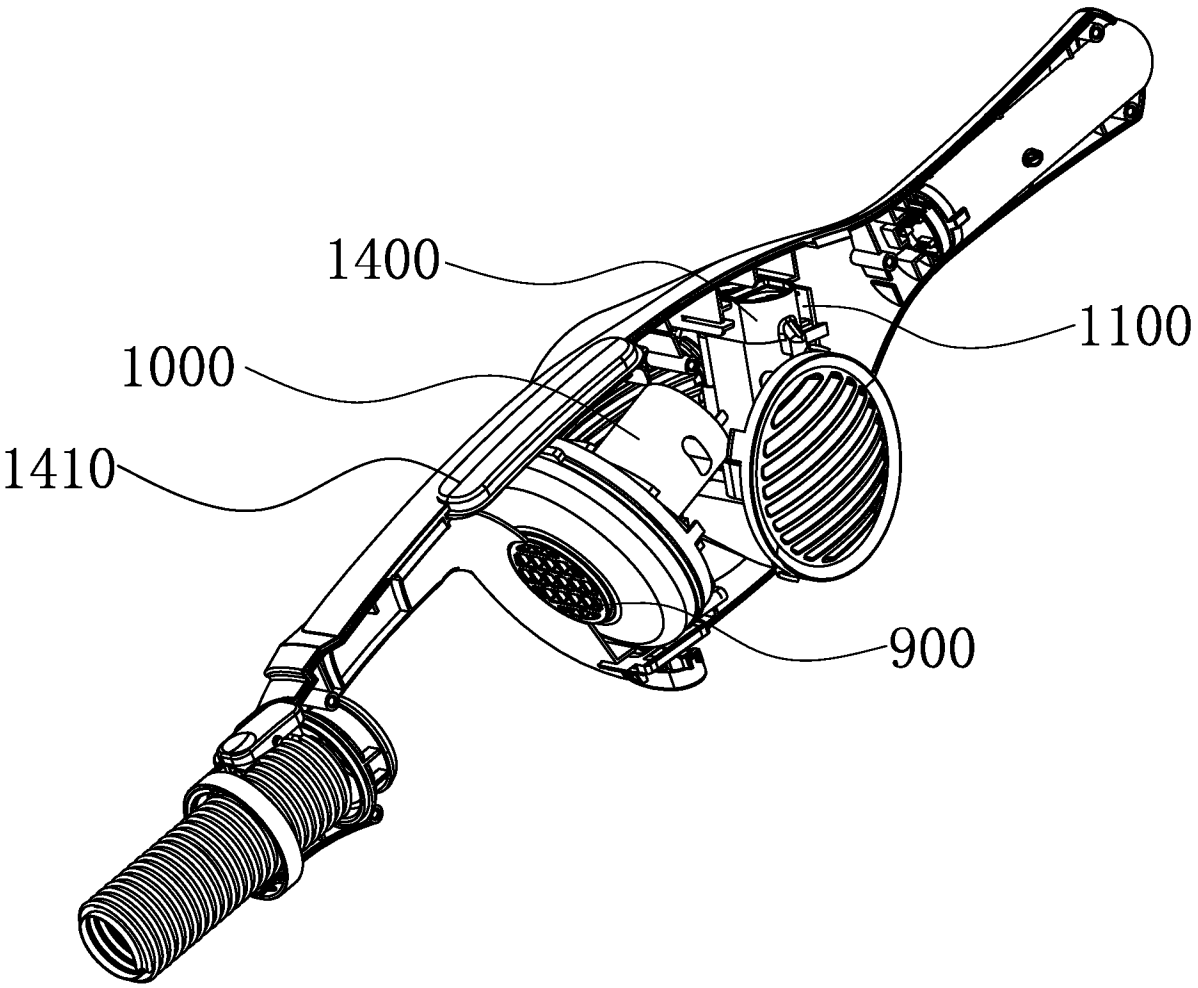
FIG. 6 is a schematic view of the interior structure of the middle section of the intelligent dust mop in a preferable embodiment of the present invention.
Figure 7:
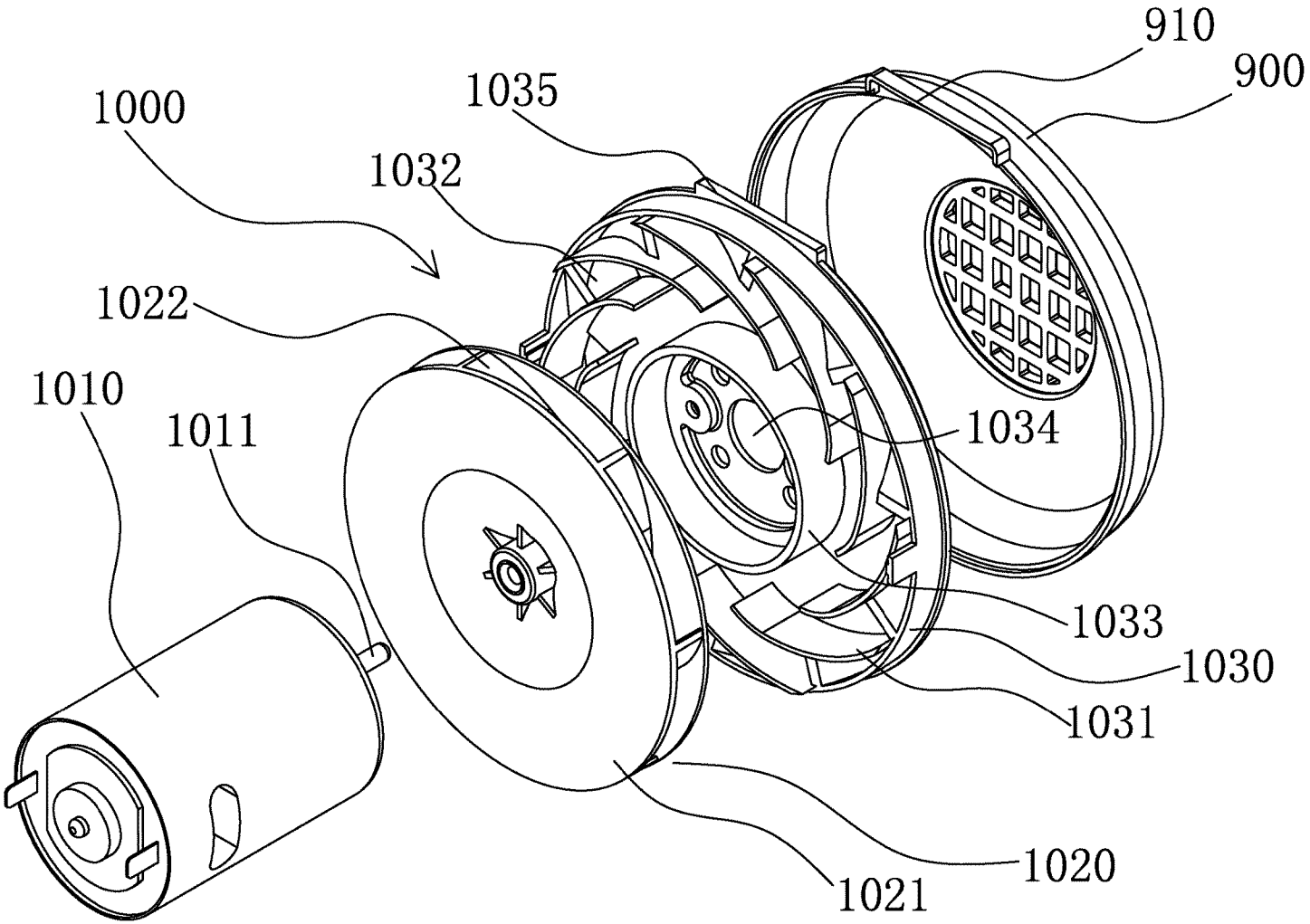
FIG. 7 is an exploded view of a micro electric control component and a filter component in a preferable embodiment of the present invention.
Figure 8:
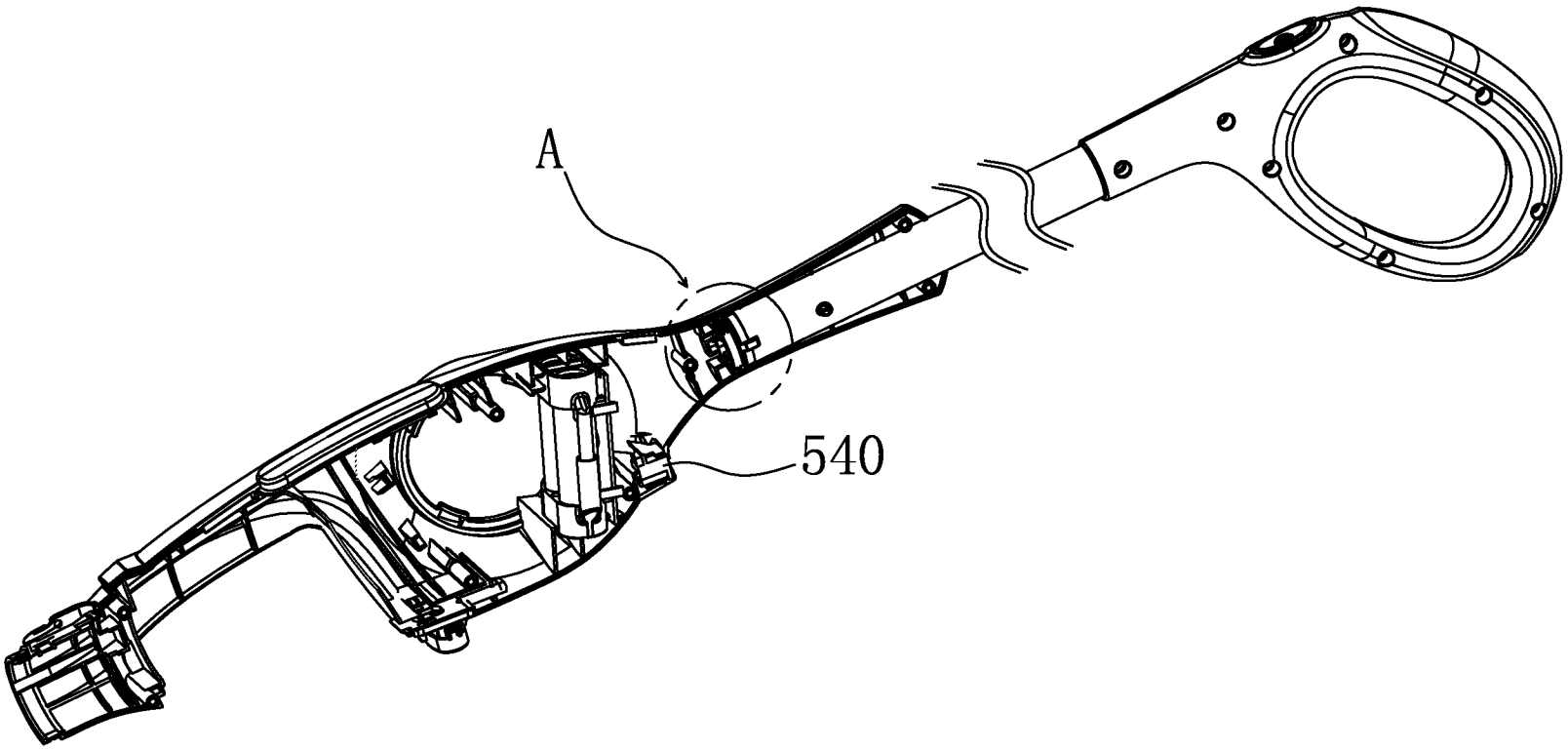
FIG. 8 is a structural view of a conductive component in a preferable embodiment of the present invention.
Figure 9:
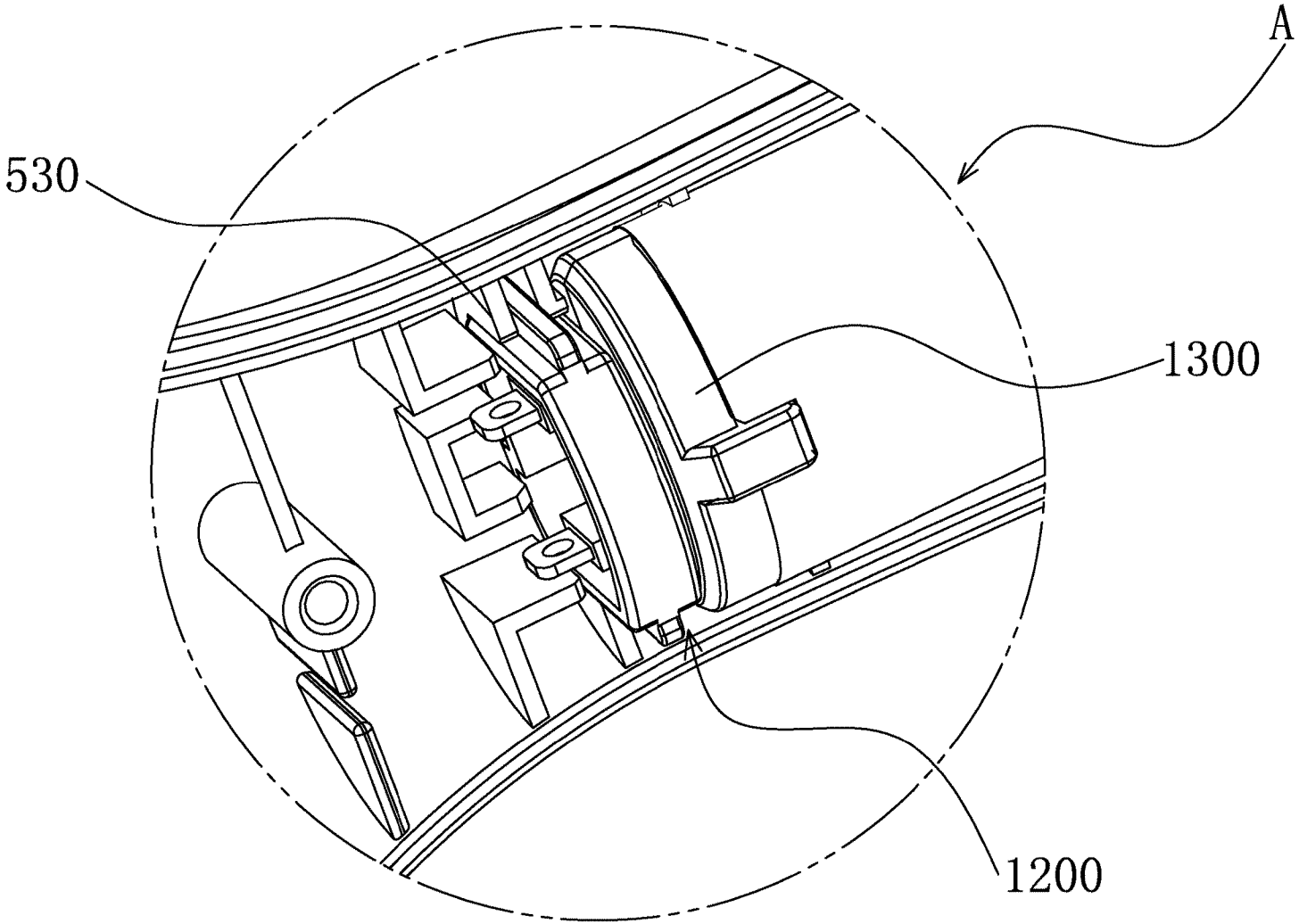
FIG. 9 is an amplified structural view of portion A in FIG. 8.
Figure 10:
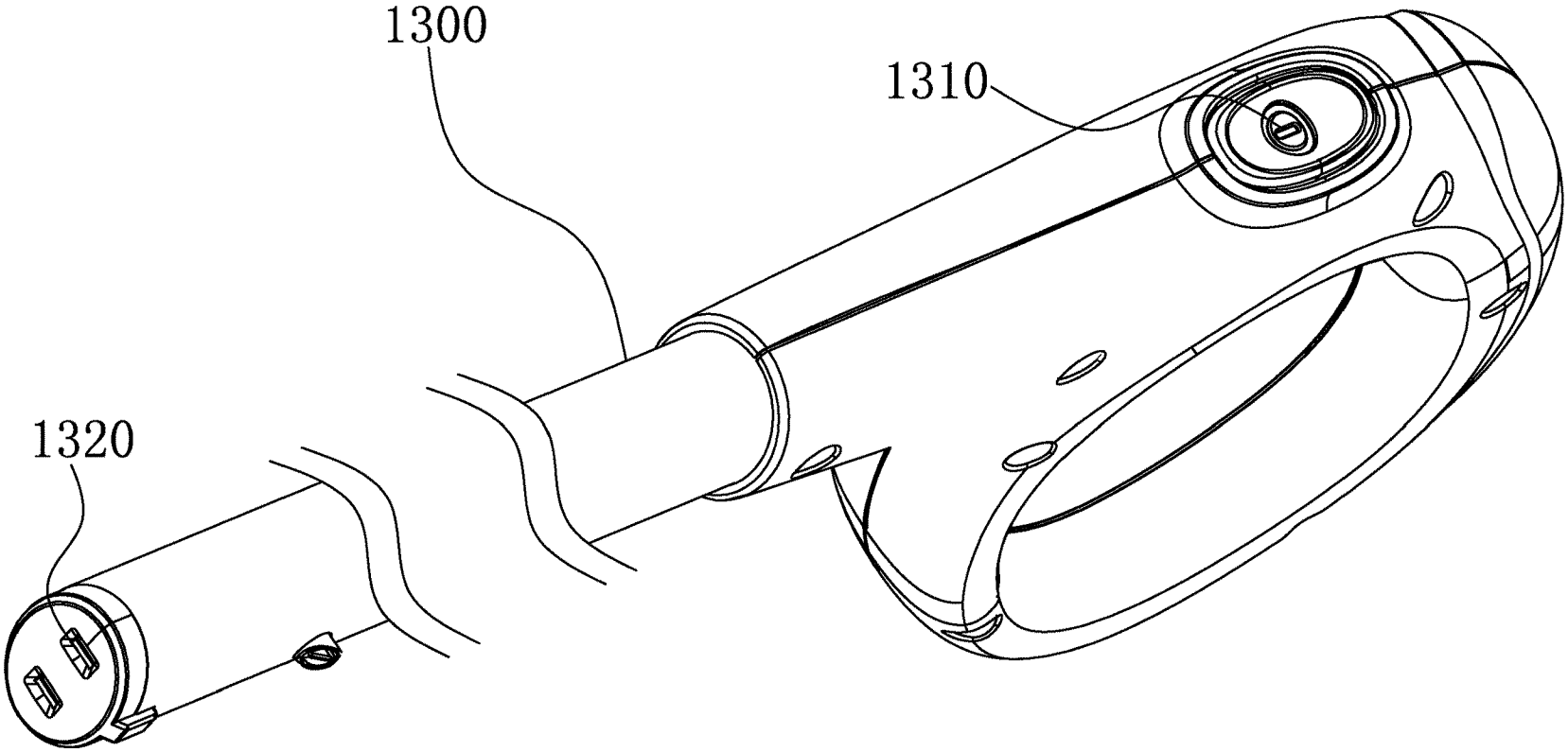
FIG. 10 is a local schematic view of a handle in a preferable embodiment of the present invention.
Figure 11:
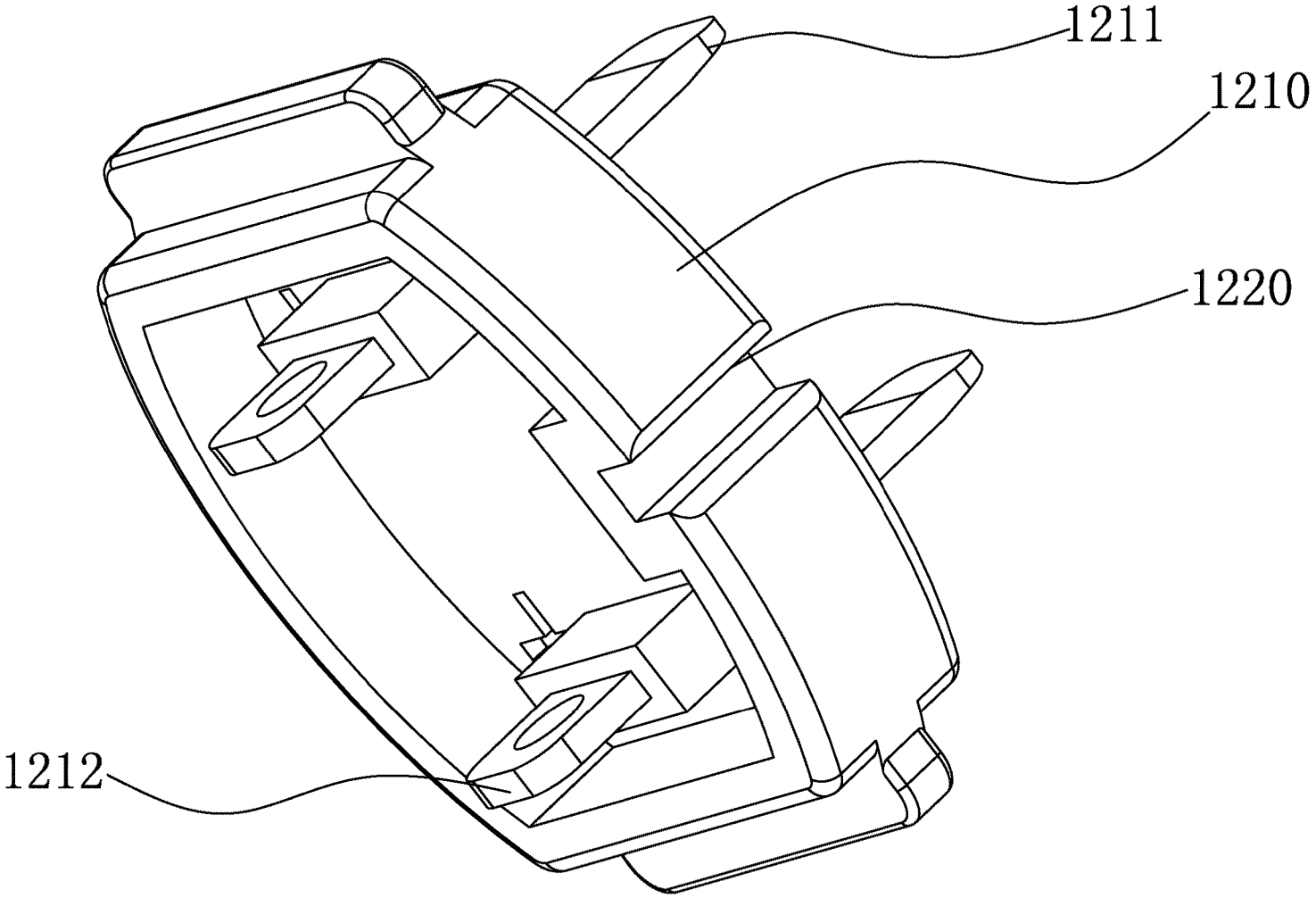
FIG. 11 is a structural view of an electric contactor in a preferable embodiment of the present invention.

Preferably, as shown in FIG. 2, FIG. 5 and FIG. 6, the housing 500 of the intelligent dust mop is provided with a detachably connected dust collecting box 800. Preferably, the dust collecting box 800 and the housing 500 are buckled, and the dust collecting box 800 and the housing 500 are disassembled and assembled through the first snap fastener 520, wherein the dust collecting box 800 is disposed between the air outlets 200 and the mop component 400, and the macromolecular contaminant particles which are kept in the housing 500 are collected in the dust collecting box 800, ensuring that the interior of the housing 500 of the intelligent dust mop is clean, preventing the macromolecular contaminant particles from coiling other parts, and improving the dust collection reliability of the intelligent dust mop. Further preferably, a notch 810 for assisting in dismantling the dust collecting box 800 is formed on a lateral wall of the dust collecting box 800, and is matched with the first snap fastener 520. The notch 810 for assisting in dismantling the dust collecting box 800 is arranged at the position where the index pointer of a user touches.

Preferably, as shown in FIG. 2, FIG. 5 and FIG. 6, a baffle 521 is disposed each one of the two sides of the first snap fastener 520, and the baffles 521 and the housing 500 are integrally molded or separately arranged; further preferably, the end faces of the baffles 521 are higher than the end face of the first snap fastener 520. When the intelligent dust mop falls down by accident and collides with the ground, the first snap fastener 520 avoids direct contact with the ground because the end faces of the 521 are higher than the end face of the first snap fastener 520, thus improving the assembling reliability of the dust collecting box 800. In addition, the middle portion of the first snap fastener 520 is a little recessed, matched with the finger pulp of user's thumb, so user feels more comfortable when using the intelligent dust mop due to the ergonomic performance, and the intelligent dust mop obtains a more elegant appearance.

Preferably, as shown in FIGS. 3-7, a filter component 900 is disposed above the opening of the dust collecting box 800, and the filter component 900 is detachably connected to the inside of the housing 500. Through the filter component 900, the macromolecular contaminant particles contained in the air that enters the housing 500 are blocked outside the filter component 900 and fall in the dust collecting box 800, while the filtered air is discharged via the air outlets 200, avoiding secondary contamination and improving the working efficiency of the mop assembly.

Preferably, as shown in FIGS. 3-7, a micro electric control component 1000 is detachably connected the filter component 900, and a PCB 1100 is electrically connected with the micro electric control component 1000, wherein the PCB 1100 is detachably connected to the inside of the housing 500, PCB 1100 drives the micro electric control component 1000 to work, and then a strong suction force is generated at the air inlet of the intelligent mop 100 such that the macromolecular contaminant particles on the ground are absorbed into the dust collection component 300 and enter the housing 500 through the mop component 400; in addition, by the effect of the filter component 900, the macromolecular contaminant particles are prevented from going forward, and fall down into the dust collecting box 800, and finally the filtered air is discharged from the air outlets 200.

Further preferably, as shown in FIGS. 3-7, the micro electric control component 1000 includes a motor 1010 which is provided with an output shaft 1011, a guide disc 1020 which is connected with the output shaft 1011 in a bushing way, and an end cap 1030 which is connected with the filter component 900 in a buckling way, wherein the guide disc 1020 is disposed between the end cap 1030 and the filter component 900, the motor 1010 drives the guide disc 1020 to rotate such that a strong suction force is generated at the air inlet 100 to absorb the macromolecular contaminant particles on the ground into the dust collection component 300; in addition, the strong suction force generated at the air inlet 100 and the rotating speed of the motor 1010 are not reduced due to the loss of electricity in the intelligent dust mop, so the intelligent dust mop is long-lasting and keeps constant output during the cleaning work.

Further preferably, as shown in FIGS. 3-7, the guide disc 1020 includes two pieces of round slabs 1021 which are parallel to each other, and a plurality of first air deflectors 1022 are disposed in front of the two slabs 1021, wherein the first air deflectors 1022 are integrally molded with the slabs 1021 or are assembled with the slabs 1021 in a split way; further preferably, the bending direction of the first air deflectors 1022 is consistent with the tangential direction of the round slabs 1021 such that the filtered air can flow out along the tangential direction (the arced face direction of the first air deflectors 1022) of the round slabs 1021. On the one hand, the smoothness of the outflow of air is enhanced; and on the other hand, the heat generated when the motor 1010 is working is effectively reduced, so the motor 1010 always keeps a relatively stable temperature during working, and the service life of the intelligent dust mop is prolonged.

Further preferably, as shown in FIG. 3-FIG. 7, the end cap 1030 is shaped as a round disc, and a plurality of second air deflectors 1031 are disposed along the axis direction of the end cap 1030 in a radiating way, wherein a gap 1032 is disposed between every two of adjacent second air deflectors 1031 so that the air that passes through the first air deflector 1022 enters the end cap 1030 via the gaps 1032, and by the effect of the second air deflector 1031 in the end cap 1030, flows out along the arced faces of the second air deflectors 1031; in such circumstances, the flow direction of the air is matched with the heading of the air discharge fences 210 on the end cap 200, thus reducing the noise frequencies of the outflow of the air, and improving the environmental-friendliness of the intelligent dust mop. Further preferably, the bending direction of the second air deflectors 1031 is consistent with the tangential direction of the end cap 1030 which is configured as a round disc 220, so the air that enters the end cap 1030 via the gaps 1032 can flow out along the tangential direction of the end cap 1030, wherein the effect of the second air deflectors 1031 is identical with the effect of the first air deflectors 1022.

Further preferably, as shown in FIG. 3-FIG. 7, an annular projection 1033 extends outwards along the thickness direction of the end cap 1030, and a round hole 1034 is formed in the middle portion of the annular projection 1033, wherein the middle portion of the annular projection 1033 serves as the installation space of the motor 1010, and the round hole 1034 serves as a run-through channel of the output shaft 1011. Further preferably, a plurality of clamping blocks 1035 are disposed along the axial direction of the end cap 1030, and the clamping blocks 1035 are positioned at the edge of the end cap 1030 and are matched with a clamping groove 910 on the filter component 900, realizing the buckling connection between the micro electric control component 1000 and the filter component 900, facilitating the disconnection between the micro electric control component 1000 and the filter component 900, clearing micromolecular contaminants that escape from the filter component 900 and remain on the guide discs 1020 and the end cap 1030, or the guide discs 1020 can be directly replaced to ensure the air deflection effect of the guide discs 1020 and the end cap 1030.

Preferably, as shown in FIGS. 8-11, the housing 500 is internally provided with a conductive component 1200; one end of the conductive component 1200 is electrically connected with the PCB 1100, and the other end of the conductive component 1200 is electrically connected with a handle 1300, wherein the handle 1300 is provided with an ON/OFF button 1310 for starting the intelligent dust mop. Further preferably, the conductive component 1200 includes an electric contactor 1210; one end of the electric contactor 1210 is connected with the PCB 1100 through a lead, and the other end of the electric contactor 1210 is in a clamped connection with the other end of the handle 1300, wherein the handle 1300 is fixed on the housing 500 through a thread fastener. In this embodiment, the electric contactor 1210 is in direct contact with the handle 1300, improving the electric conduction between the electric contactor 1210 and the handle 1300, thus ensuring the electrifying reliability and safety of the intelligent dust mop; besides, the handle 1300 is an aluminum alloy thickened rod which has a light weight and high strength and is spliced with the housing 500 in a seamed way, so the use is safer.

Further preferably, as shown in FIGS. 8-11, the PCB 1100, the electric contactor 1210 and the handle 1300 keep a relatively constant distance two by two, which means that any two of the three structures keep still with respect to each other, further improving the electrifying reliability of the intelligent dust mop.

Further preferably, as shown in FIGS. 8-11, the electric contactor 1210 and the handle 1300 are in male-female match, wherein one of the implementation modes can be that the convex portion on the electric contactor 1210 is matched with the concave portion on the handle 1300, and another one of the implementation modes can be that the concave portion on the electric contactor 1210 is matched with the convex portion on the handle 1300. Further preferably, the electric contactor 1210 is matched with the handle 1300 in a plugged way to limit the relative distance between the electric contactor 1210 and the handle 1300, and the electric contactor 1210 and the handle 1300 are connected in a plugged way such that the elective conduction between the two is more reliable and smooth and that the assembling is more stable.

Further preferably, as shown in FIGS. 8-11, the electric contactor 1210 is provided with two symmetric contact pieces 1211 which are matched with two concave holes 1320 on the handle 1300, realizing the plugged connection between the electric contactor 1210 and the handle 1300. The match between the two contact pieces 1211 and the two concave holes 1320 limits the circumferential degree of freedom of the handle 1300 which is installed on the electric contactor 1210, prevents the handle 1300 of the intelligent dust mop from rotating and shaking during working, and improves the electrifying reliability of the intelligent dust mop. Further preferably, the electric contactor 1210 at the position opposite to the contact pieces 1211 is provided with two terminals 1212 which are electrically connected with the PCB 1100 through leads, and when the PCB 1100 switches the connection between the electric contactor 1210 and the handle 1300, the ON/OFF button 1310 can be pressed to start the intelligent dust mop.

Further preferably, as shown in FIGS. 8-11, the electric contactor 1210 has a third positioning portion 1220 at the edge, and the third positioning portion is matched and connected with a fourth positioning portion 530 of the housing 500 such that the installation of the electric contactor 1210 is more stable, further ensuring the reliability of connection between the electric contactor 1210 and the handle 1300; further preferably, the third positioning portion 1220 includes at least one convex portion and at least one concave portion, and the convex portion in the third positioning portion 1220 is matched with the concave portion in the fourth positioning portion 530, while the concave portion in the third positioning portion 1220 is matched with the convex portion in the fourth positioning portion 530.

Further preferably, as shown in FIGS. 8-11, the housing 500 is also internally provided with a lithium battery component 1400 and is electrically connected with the PCB 1100, wherein the housing 500 is also provided with a charging block 540, and the charging block 540 is electrically connected with the PCB 1100. The charging block 540 realizes the charging of the lithium battery component 1400, and releases the intelligent dust mop from charging wires during working. In addition, the lithium battery component 1400 in this embodiment is 2,900 mAh and can maintain a strong current for 20-25 min, so the intelligent dust mop has sufficient time to collect dust and mop the ground.

Further preferably, as shown in FIGS. 8-11, a power display screen 1410 is embedded on the surface of the housing 500 to detect the power of the lithium battery component 1400 in real time, bringing convenience in that the user can charge the intelligent dust mop in time.

Further preferably, as shown in FIGS. 8-11, an auxiliary grip 550 is disposed at the joint between the housing 500 and the handle 1300, wherein the auxiliary grip 550 is integrally molded with the housing 500, so the user can change the position of the grip upon required length and improve the conformable experience of the user.

Preferably, as shown in FIGS. 1 and 2, the housing 500 is provided with a second snap fastener 560, and the second snap fastener 560 is arranged close to the position of the mop component 400 to serve as the buckling button for replacing functional tool bit (combination of the dust collection component 300 and mop component 400).

Embodiment 2

Figure 12:
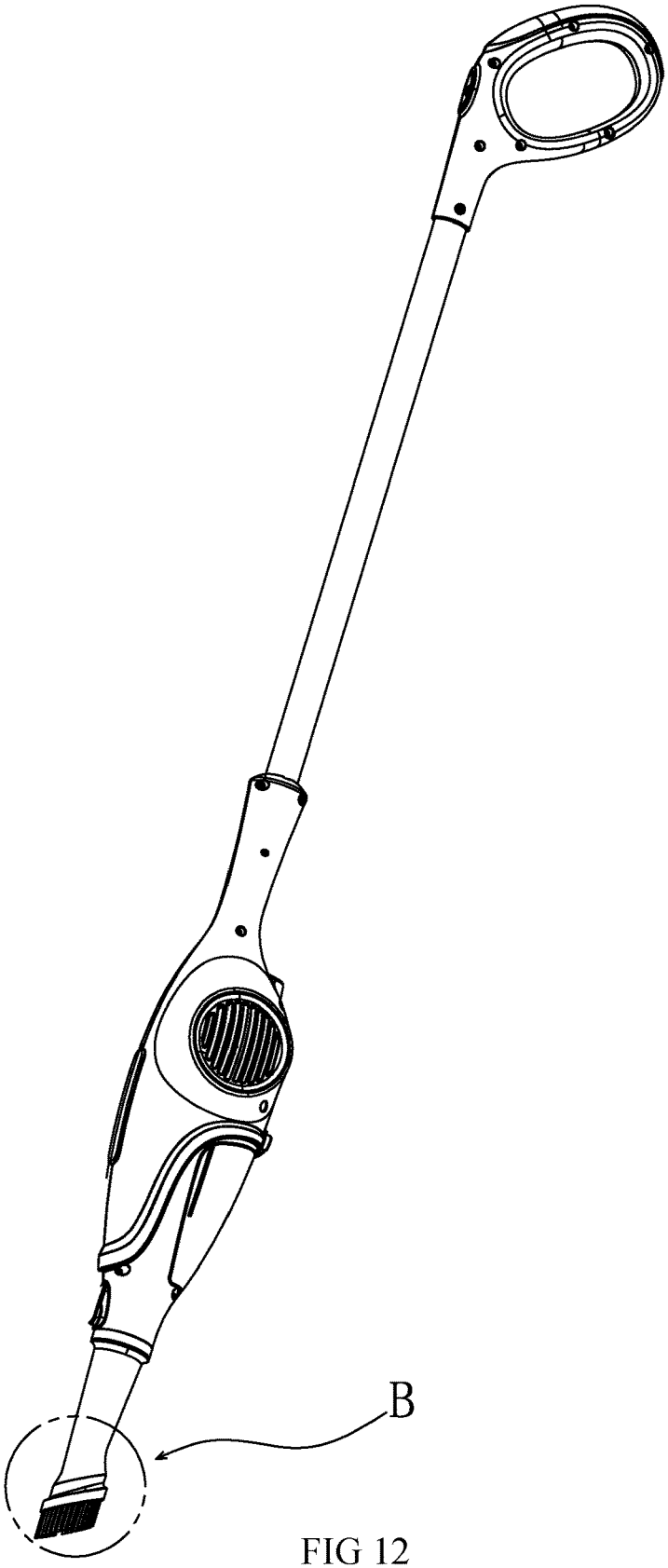
FIG. 12 is a structural view of another embodiment of the present invention.
Figure 13:
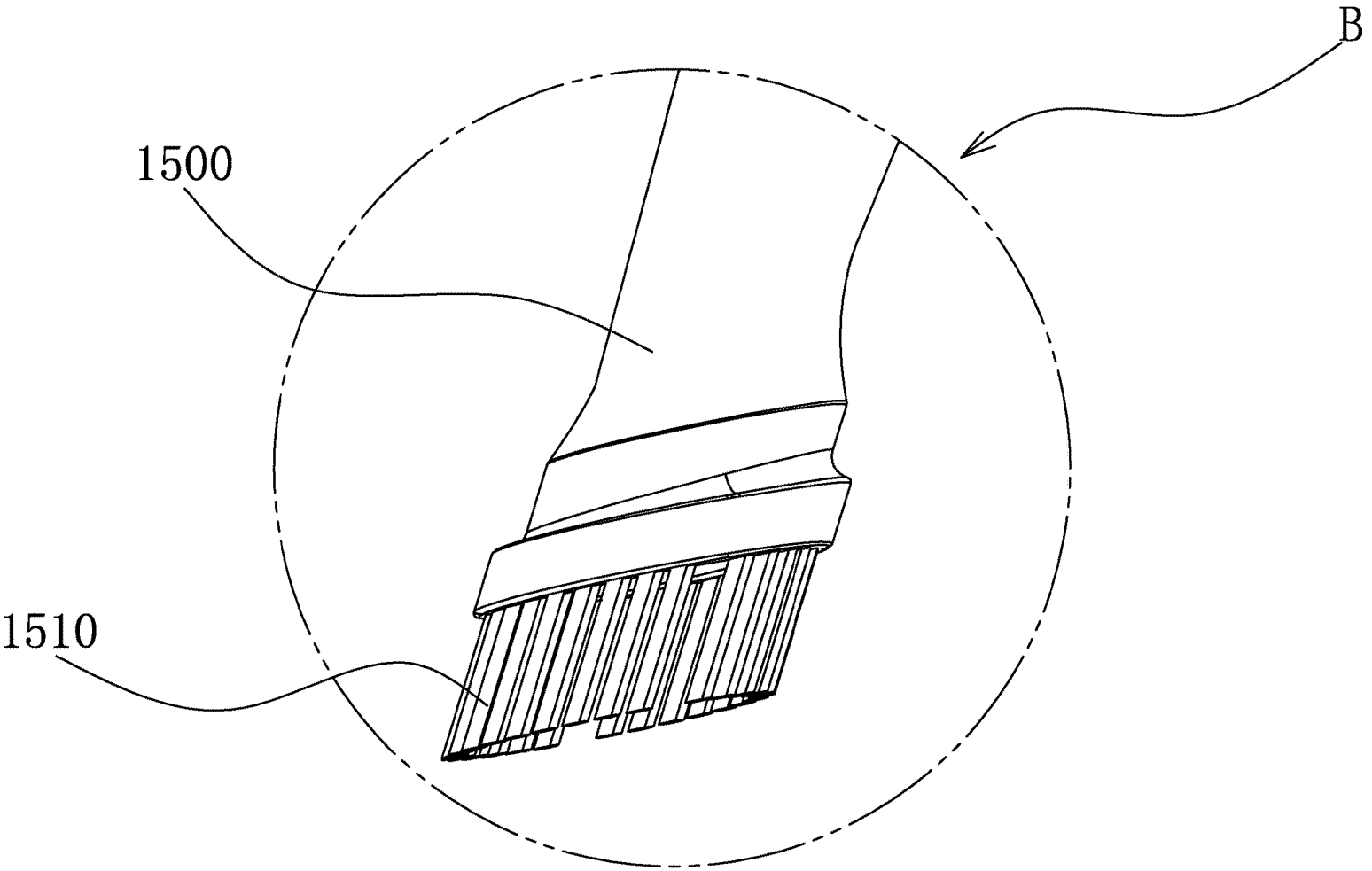
FIG. 13 is an amplified structural view of portion B in FIG. 12.

As shown in FIGS. 12 and 13, this embodiment is different from embodiment 1 in that, the functional tool bit in embodiment 1 is replaced, which means that the function tool bit in embodiment 1 is dismantled using the second snap fastener 560, and a dust nozzle 1500 is installed on the housing 500 and is clamped and fixed through the second snap fastener 560. The dust nozzle 1500 can clean seams and wall faces of higher positions, making sure that the room is clean. Further preferably, a hair brush 1510 is implanted along the edge of the mouth of the dust nozzle 1500, preferably a flexible hair brush is adopted, to remove net-like contaminants at the seams or wall faces, such as spider web, thus further improving the cleaning reliability and versatility of the intelligent dust mop.

The specific embodiments described in the text are used for illustrating the principle of the present disclosure only. Those skilled in the field can make various amendments or supplementations or take similar substitutions on the basis of the described specific embodiments. The amendments, supplementations and substitutions shall fall within the principle or the protective scope claimed by the claims of the present disclosure.

The invention claimed is:

1. An intelligent dust mop, comprising:

an air inlet;

at least one air outlet;

a dust collection component; and a mop component in a detachable connection with the dust collection component being disposed at the position of the air inlet;

wherein the dust collection component moves up and down along the thickness direction of the mop component;

at least one elastic component having two ends is disposed between the dust collection component and the mop component, and wherein the two ends of the elastic component are respectively connected with the dust collection component and the mop component;

the dust collection component has a first positioning portion for embedding one end of the at least one elastic component, and the mop component has a second positioning portion for clamping the other end of the at least one elastic component, wherein the first positioning portion and the second positioning portion are in a rotary plugged connection, the operation of the at least one elastic component permitting the dust collection component to automatically move up and down along the thickness direction of the mop component during operation.

2. The intelligent dust mop according to claim 1, wherein a plurality of air discharge fences are disposed at the position of the air outlet, and each one of the air discharge fences is inclined downward.

3. The intelligent dust mop according to claim 2, wherein the middle portion of each one of the air discharge fences protrudes such that the air discharge fences entirely form an arch-structure.

4. The intelligent dust mop according to claim 1, wherein the mop component comprises a base plate, and the base plate is provided with sticky barbs for absorbing and sticking a piece of mopping cloth.

5. The intelligent dust mop according to claim 1, wherein a housing of the intelligent dust mop is in a detachable connection with a dust collecting box, and the dust collecting box and the housing are disassembled and assembled through a snap fastener, wherein the dust collecting box is positioned between the air outlet and the mop component.

6. The intelligent dust mop according to claim 5, wherein a notch for assisting in dismantling the dust collecting box is formed on a lateral wall of the dust collecting box, wherein the notch and the first snap fastener are positioned on the same vertical plane.

7. The intelligent dust mop according to claim 5, wherein a baffle is disposed on each one of the two sides of the first snap fastener, and the baffles and the housing are integrally molded or separately arranged, wherein end faces of the baffles are higher than an end face of the first snap fastener.

8. The intelligent dust mop according to claim 5, wherein a filter component is disposed above the opening of the dust collecting box, and the filter component is detachably connected to the inside of the housing.

9. The intelligent dust mop according to claim 8, wherein a micro electric control component is in a detachable connection with the filter component, and a PCB is electrically connected with the micro electric control component, wherein the PCB is detachably connected to the inside of the housing.

10. The intelligent dust mop according to claim 9, wherein the micro electric control component comprises a motor which is provided with an output shaft, a guide disc which is connected with the output shaft through a bushing, and an end cap which is connected with the filter component using a buckling method, wherein the guide disc is positioned between the end cap and the filter component.

11. The intelligent dust mop according to claim 10, wherein the guide disc comprises two parallel slabs, and a plurality of first air deflectors are disposed in front of the two slabs, wherein the first air deflectors are integrally molded with the slabs or are assembled with the slabs in a split way.

12. The intelligent dust mop according to claim 11, wherein the bending direction of the first air deflectors is consistent with the tangential direction of the slabs.

13. The intelligent dust mop according to claim 9, wherein the housing is internally equipped with a conductive component; one end of the conductive component is electrically connected with the PCB, and the other end of the conductive component is electrically connected with a handle, wherein the handle is provided with an ON/OFF button for starting the intelligent dust mop; the conductive component includes an electric contactor, one end of the electric contactor is connected with the PCB through leads, and the other end of the electric contactor is electrically connected with the handle; the electric contactor is provided with two symmetric contact pieces which are matched with two concave holes on the handle, realizing plugged connection between the electric contactor and the handle; the electric contactor at a position opposite to the contact pieces is provided with two terminals that are electrically connected with the PCB through leads.

14. The intelligent dust mop according to claim 9, wherein the housing is also internally provided with a lithium battery component which is electrically connected with the PCB, wherein the housing is also provided with a charging block, and the charging block is electrically connected with the PCB.

15. The intelligent dust mop according to claim 1, wherein the housing is provided with a second snap fastener, and the second snap fastener is positioned close to the map component to realize buckling connection between the mop component and the housing.

* * * * *